US006966842B1

(12) United States Patent
Rieber

(10) Patent No.: US 6,966,842 B1
(45) Date of Patent: Nov. 22, 2005

(54) ADJUSTABLE SWING SEAT

(76) Inventor: Frederick M. Rieber, 325 Weaver Rd., Alum Bank, PA (US) 15521

( * ) Notice: Subject to any disclaimer, the term of this patent is extended or adjusted under 35 U.S.C. 154(b) by 0 days.

(21) Appl. No.: 10/837,623

(22) Filed: May 4, 2004

(51) Int. Cl.[7] ..... A63G 9/00
(52) U.S. Cl. ..... 472/118; 297/273
(58) Field of Search ..... 472/118–125; 297/273, 344.21; 482/142, 143, 146, 147

(56) References Cited

U.S. PATENT DOCUMENTS 2,375,087 A * 5/1945 De Bruin ..... 206/577
3,712,614 A 1/1973 Sherman et al.
3,937,463 A * 2/1976 Soisson ..... 472/118
3,981,500 A * 9/1976 Ryan ..... 248/274.1
5,338,260 A 8/1994 Smith
5,427,575 A * 6/1995 Berk ..... 472/118
5,791,999 A 8/1998 Lauro et al.
6,500,072 B1 12/2002 Myers et al.

* cited by examiner

*Primary Examiner*—Kien Nguyen
(74) *Attorney, Agent, or Firm*—McDermott Will & Emery LLP

(57) ABSTRACT

A swing seat for a swing includes a seat shell and a reel movable between first and second axial positions relative to the seat shell. The reel is configured to be attached to a line, and when the reel is in the first axial position, rotation of the reel in one direction is prevented. When the reel is in the second axial position, the reel is capable of rotating in both directions. When rotating in the second rotational direction, the reel takes up the line, and when rotating in the first rotational direction, the reel extends the line. A release is used to move the reel from the first axial position to the second axial position.

20 Claims, 11 Drawing Sheets

ADJUSTABLE SWING SEAT

TECHNICAL FIELD

The technical subject matter relates generally to playground equipment and, more specifically, to a swing seat in which the height of the swing seat is capable of being adjusted.

BACKGROUND ART

A swing is a common piece of play equipment found in nearly every school yard and playground. The typical swing usually includes nothing more than a seat, a pair of lines (such as a rope, chain, etc.) that support the seat and a structure to which the pair of lines are attached. The popularity of swings extends from the youngest child to the oldest adult, but this widespread use presents an issue that all people are not alike. Specifically, the ideal height of the seat relative to ground varies depending upon the height of the person in the seat, and obtaining the ideal height of seat requires adjustment of the swing.

Many techniques have evolved to adjust the height of the seat, but there are problems associated with all of these techniques. For example, one technique is to simply wrap the seat and lines around the pole from which the lines hang, which shortens the lines and raises the height of the seat. This technique, however, can damage or even break the lines. Another technique involves using chain link for the lines and adjusting the particular link to which either the pole or seat is attached, and in this manner, the line can be shortened or lengthened. This technique, however, suffers from the problem that links may not be properly connected back to either the pole or seat, and thus, can cause separation of the link from the seat of pole. Also, adjustment of the seat in this manner may require adult supervision. Furthermore, because each line must be adjusted separately, the height of the two lines may be uneven, causing the seat to sag toward the longer line.

Certain manufacturers of swings provide adjustment mechanisms that require an adult to use. However, these adjustment mechanisms may create loops in the lines that pose a potential entrapment threat to children. Also, since each line must be adjusted separately, the height of the two lines may be uneven. Accordingly, a need exists for an improved swing seat for a swing that allows for easy adjustment of the height of the seat but does not require adult supervision and ensures that both sides of the seat are evenly adjusted.

SUMMARY

This and other needs are met, for example, by an improved swing seat having a seat shell and a reel movable axially between first and second axial positions relative to the seat shell. The reel is configured to be attached to one or more lines. By rotating the reel in one direction, the reel takes up the line, and by rotating the reel in the opposite direction, the reel extends the line. When the reel is in the first axial position, rotation in the one direction is prevented by mechanical interference between the reel and the seat shell. When the reel is in the second axial position, the reel is capable of rotating in either direction. A release connected to the reel is used to move the reel between the axial positions.

Movement of the reel into the first axial position against the seat shell engages a ratchet to prevent rotation of the reel in the one direction. With the reel in the second axial position, the ratchet disengages to allow rotation of the reel relative to the seat shell in both directions. The release restricts movement of the reel relative to the seat shell between the first and second axial positions. Axial movement of the reel relative to the seat shell is limited by the reel at one end and the release engaging the seat shell at the other.

Additional advantages will become readily apparent to those skilled in the art from the following detailed description, wherein only an exemplary embodiment is shown and described, simply by way of illustration. As will be realized, the disclosed technology is capable of other and different embodiments, and its several details are capable of modifications in various obvious respects. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Figure 1A:
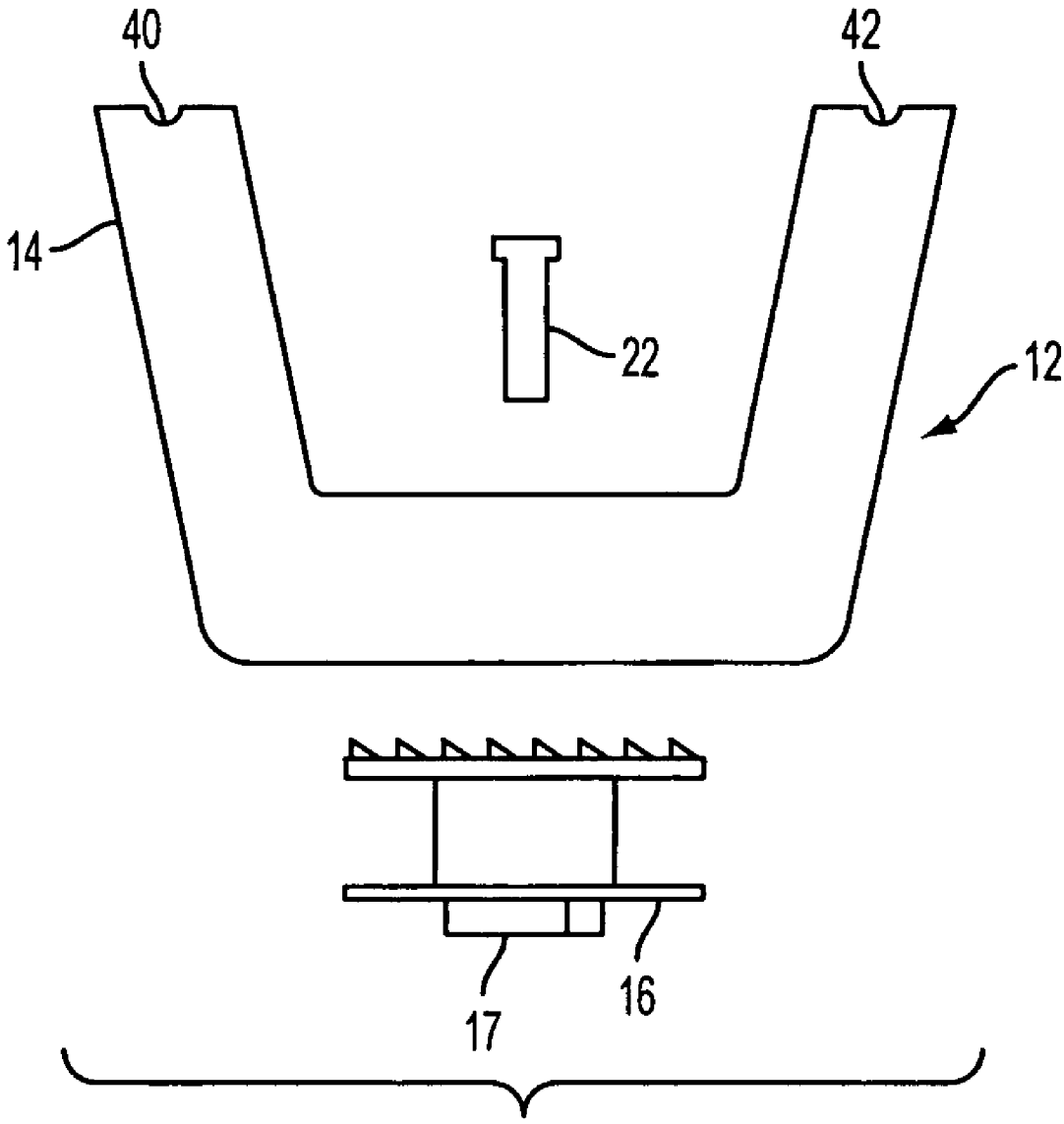
FIG. 1A is an exploded view of a swing seat.
Figure 1B:
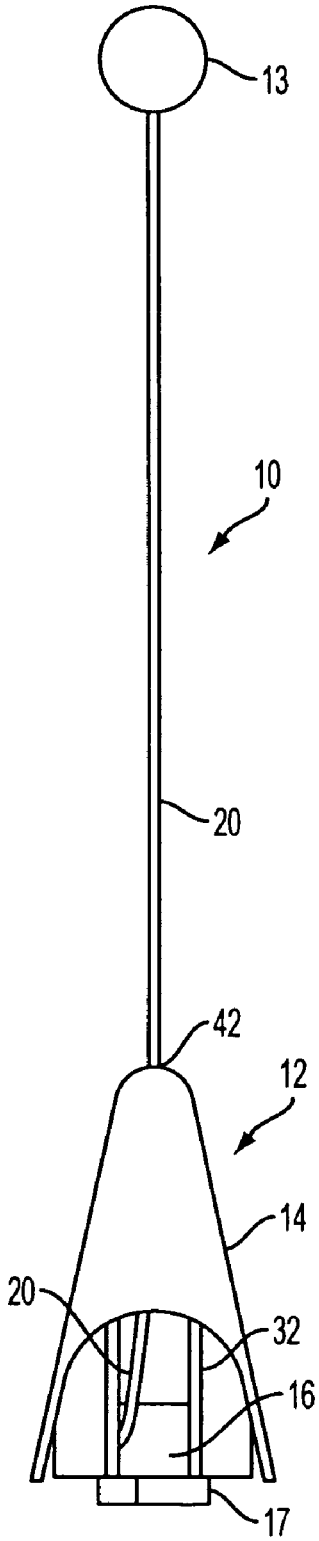
FIG. 1B is a side view of a swing that includes the swing seat.
Figure 1C:
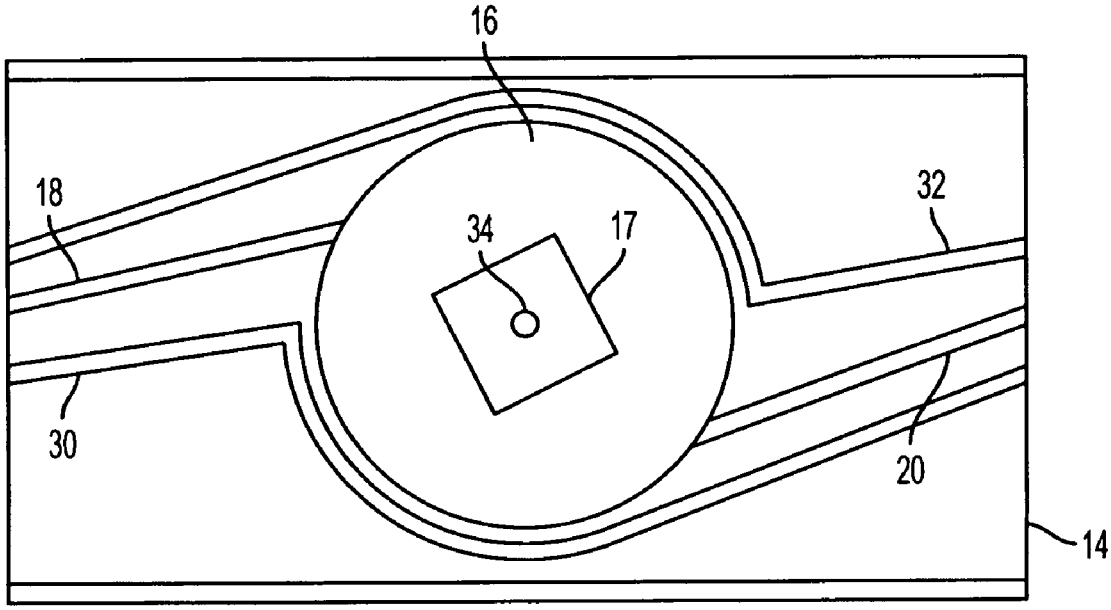
FIG. 1C is a bottom view of the swing seat.

A swing 10 having a swing seat 12 connected to a support structure 13, such as a pole, with lines 18, 20 is illustrated in FIGS. 1A–C. The swing seat 12 includes a seat shell 14 and a reel 16 configured to be attached to ends of the lines 18, 20. The reel 16 is arranged to rotate clockwise or counterclockwise (first and second directions) relative to the seat shell 14. The swing seat 12 may also include a release 22 (FIG. 1A) that is attached to the reel 16. Channels 30, 32 in the swing seat 12 guide the lines 18, 20 along the seat shell 14 from the reel 16 to openings 40, 42 where the lines 18, 20 exit the seat shell 14.

When the reel 16 is rotated relative to the seat shell 14 in the first rotational direction, the reel 16 dynamically extends the lines 18, 20 from the reel 16. Conversely, when the reel 16 rotates relative to the seat shell 14 in the second rotation direction, the reel 16 takes up the lines 18, 20 into the reel 16. Alternatively, the take-up and feed out rotational directions of the reel 16 may be reversed.

Figure 2A:
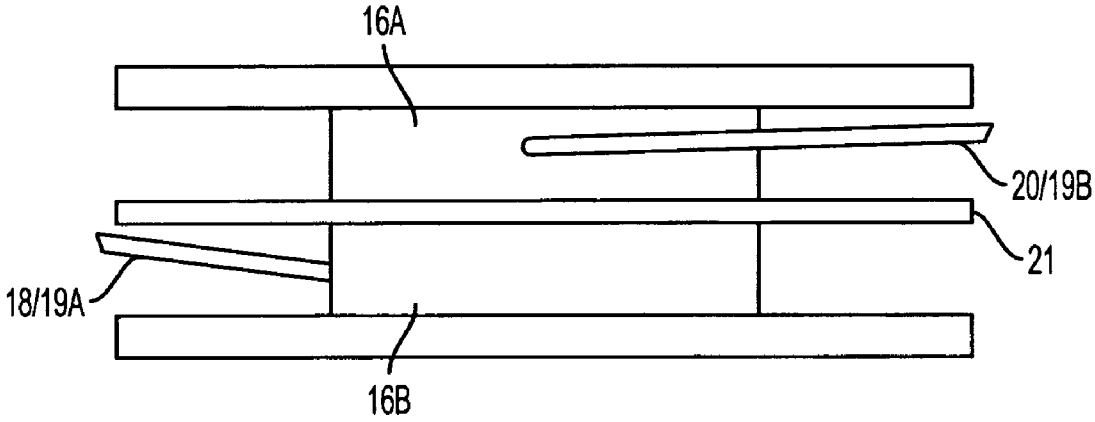
FIG. 2A is a side view of a split reel attached to two separate lines.
Figure 2B:
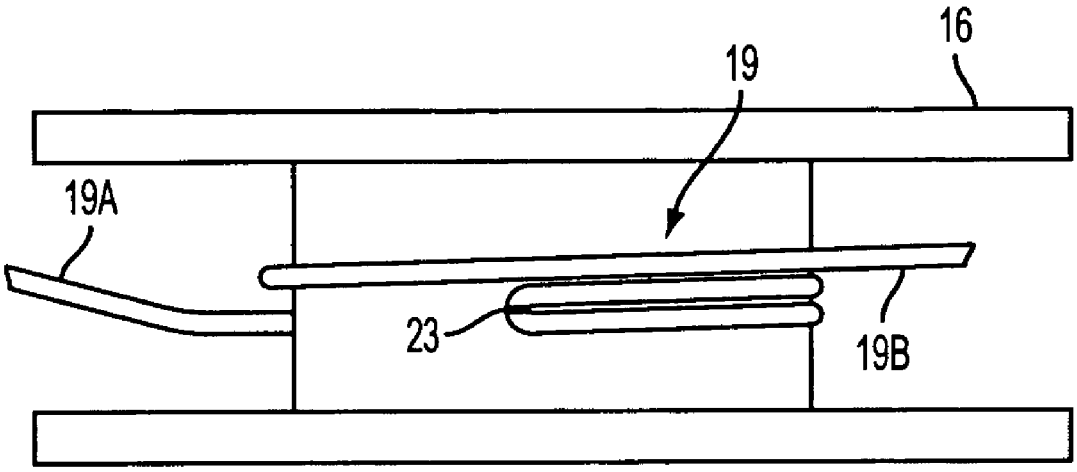
FIG. 2B is a side view of a reel attached to a single line.
Figure 2C:
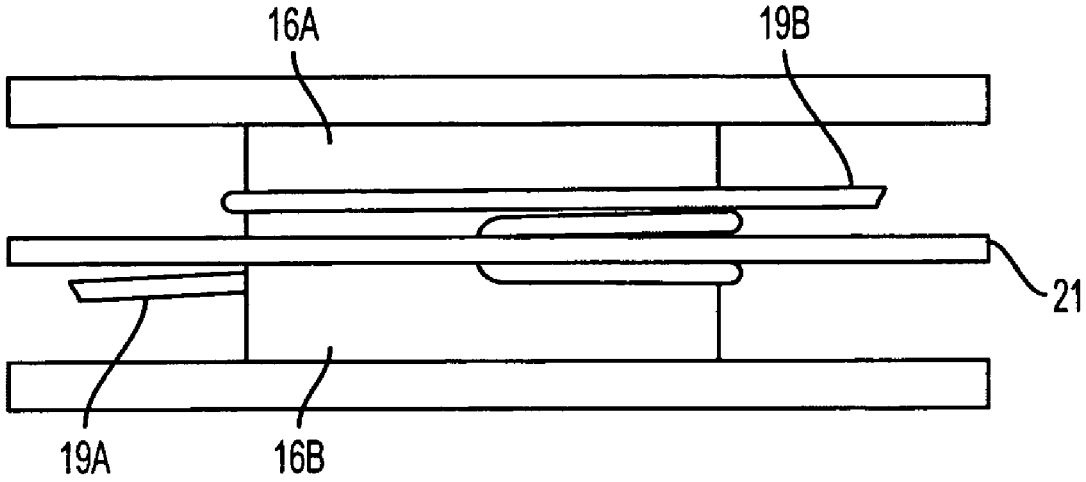
FIG. 2C is a side view of a split reel attached to a single line.

The swing seat 12 is not limited as to any particular types of lines 18, 20 to which the swing seat 12 is attached. For example, the lines 18, 20 may be cable, rope, chain or any other material capable of use with the swing 10. As illustrated in FIG. 2A, multiple lines 18, 20, each separately attached to the reel 16, may be used with the swing seat 12, or as illustrated in FIGS. 2B, 2C, a single line 19 can be attached to the reel 16, with a first length 19A extending from one side of the reel 16 and a second length 19B extending from another side of the reel 16. For example, as illustrated in FIG. 2B, a single line 19 can be attached to the reel 16 at a fold-back using a connector 23, such as a hook or staple.

An alternative manner of attaching a single line 19 or lines 18, 20 to the reel is illustrated in FIG. 2A. When using two lines 18, 20, each line 18 or 20 may be attached to opposite sides of the reel 16 using any suitable method for attaching a line to a reel. For example, one end of the line 18 or 20 can inserted into a hole in the reel 16, and a knot (or other feature larger than the hole) in the line 18 or 20 can be used to prevent the end of the line 18 or 20 from being removed from the reel 16. Alternatively, when using a single line 19, the line 19 can be threaded through opposite holes in the reel 16 such that one end of the line 19A extends from one hole in the reel 16 and the other end of the line 19B extends from the other hole in the reel 16.

Multiple reels 16 can be used to take up a given line 18, 20 or a length 19A, 19B of a line. For example, a pair of stacked reels (not shown) can be positioned on both lateral sides of the swing seat 12. These reels can also include a drive shaft that interconnects one reel to another.

In a preferred embodiment of the swing seat 12, however, a single reel 16 is implemented to take up and let out both lines 18, 20 or both lengths 19A, 19B of the line 19. Using a single reel 16 to take up and let out both lines 18, 20 or both lengths 19A, 19B of the line 19, ensures that the amount of line let out or taken up by the reel 16 is equal on both sides. This advantageously keeps one side of the swing seat 12 from being lower than the other side of the swing seat 12. This also optimizes the design by consolidating the afore-mentioned shaft, additional reel, and ratchet mechanism. Although not necessary, the reel 16 can include, or be attached to, a knob 17 for gripping by a user and used to help rotate the reel 16 in either directions.

The reel 16 may be divided into two halves 16*a*, 16*b*, for example, by a divider 21, as illustrated in FIGS. 2A, 2C, in which one line 18 or length 19A of a line 19 is associated with one half 16*a* of the reel 16, and the other line 29 or length 19B of the line 19 is associated with the other half 16*b* of the reel 16. By dividing the reel in halves 16*a*, 16*b*, entanglement of the lines 18, 20 or portions 19*a*, 19*b* of the line can be prevented.

Figure 3A:
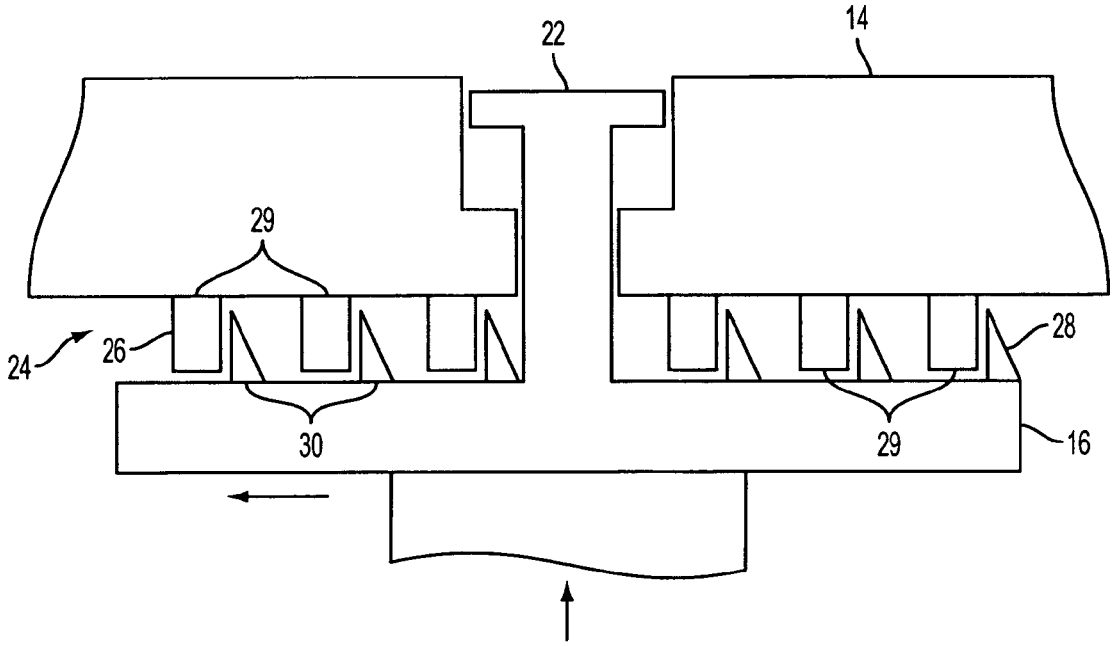
FIGS. 3A and 3B are cross-sections of the swing seat that respectively illustrate a reel in a first axial position and in a second axial position relative to a seat shell of the swing seat.

The reel 16 is movable between two axial positions relative to the seat shell 14. In a first axial position (best shown in FIG. 3A), rotation of the reel 16 in a first rotational direction (represented by a left-pointing arrow and counterclockwise when viewed from below) relative to the seat shell 14 is prevented. The swing seat 12 is not limited in the manner in which rotation of the reel 16 in the first rotation direction relative to the seat shell 14 is prevented. In accord with one aspect of the swing seat 12, however, weight placed upon the seat shell 14, such as by sitting on it, engages a ratchet 24 that acts to prevent rotation of the reel 16 relative to the seat shell 14 in the first rotational direction. When engaged, a ratchet prevents rotation in one rotational direction. Certain types of ratchets, when engaged, allow rotation in an opposite direction, and still other types of ratchets, when engaged, prevent rotation in both directions. Either type of ratchet (i.e., preventing rotation in a single direction or both directions) can be employed with the present swing seat 12.

Although many types of ratchets 24 are capable of use with the present swing seat 12, preferably, the ratchet includes a pawl 26 attached to one of either the seat shell 14 or the reel 16 and a plurality of teeth 28 attached to the other of the seat shell 14 and the reel 16. When the reel 16 engages the seat shell 14 in the first axial position, the front faces 30 of the plurality of teeth 28 engage the individual members 29 of the pawl 26. This mechanical interference between the plurality of teeth 28 and the pawl 26 prevents rotation in the first rotational direction of the reel 16 relative to the seat shell 14.

By loading the seat shell 14 (for example, by someone sitting on the swing seat 12), the seat shell 14 is caused to engage the reel 16. The reel 16 is attached to the lines 18, 20, which holds the reel 16 stationary. Furthermore, when the seat shell 14 engages the reel 16, rotation of the reel 16 in the first rotational direction is prevented. Since the lines 18, 20 are played out from the reel 16 when the reel rotates in the first rotation direction, by placing weight upon the seat, the lines 18, 20 are prevented from playing out from the reel 16. Therefore, when someone sits on the swing seat 12, the swing seat 12 can no longer be lowered.

When the reel 16 is in the second axial position (best shown in FIG. 3B), clockwise (or counterclockwise) rotation of the reel 16 is enabled. With the particular type of ratchet 24 illustrated, disengagement is achieved as the pawl 26 separates from the plurality of teeth 28, and any apparatus capable of separating the pawl 26 from the plurality of teeth 28 is acceptable for use in the swing seat 12.

Figure 3B:
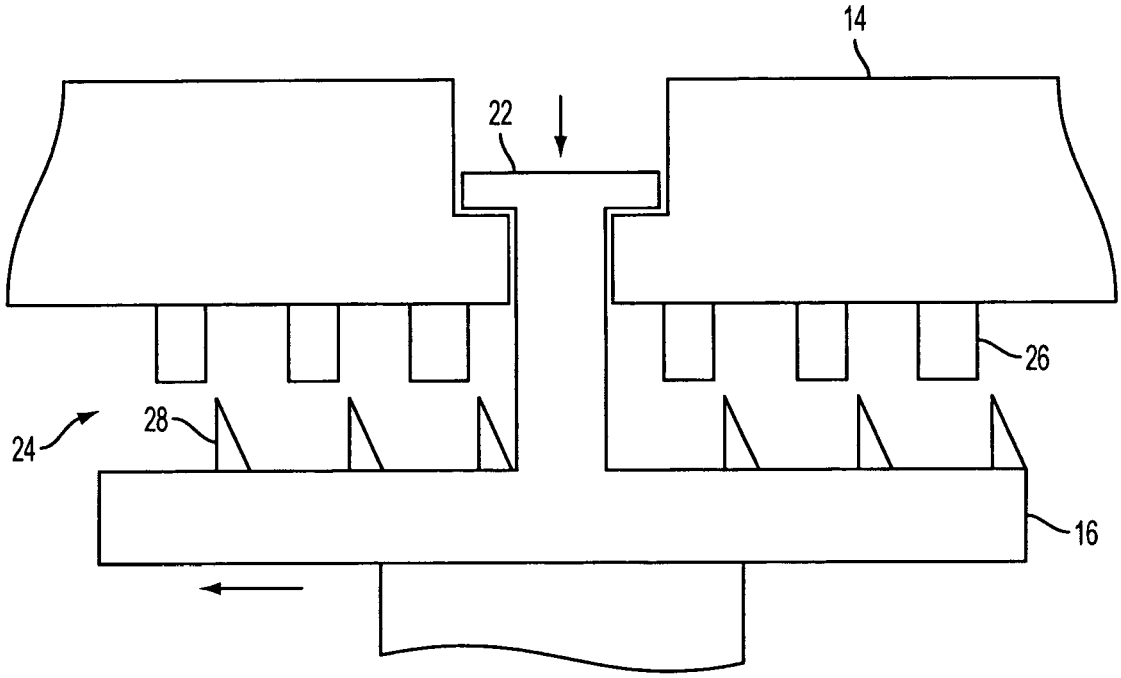

In one aspect of the swing seat 12, a release 22 is used to disengage the ratchet 24, and any release 22 capable of disengaging the ratchet 24 is acceptable for use with the swing seat 12. The release 22 is attached to the reel 16 using, for example, a screw 34 (best shown in FIGS. 4A–C), and is movable relative to the seat shell 14 in a direction in which movement of the reel 16 relative to the seat shell 14 disengages the ratchet 24. As illustrated in FIG. 3B, when the release 22 is moved relative to the seat shell 14, the reel 16 also moves relative to the seat shell 14, which disengages the pawl 26 from the plurality of teeth 28. In this manner, the ratchet 24 is disengaged and the reel 16 can rotate relative to the seat shell 14 in the first rotation direction, which allows the swing seat 12 to be lowered because the lines 18, 20 are released from the reel 16 in the first rotational direction. The flanged end of the release 22 and the reel 16 themselves act to prevent the seat shell 14 and the reel 16 from fully disengaging by limiting the axial movement of the reel 16 and the seat shell 14.

Figure 4A:
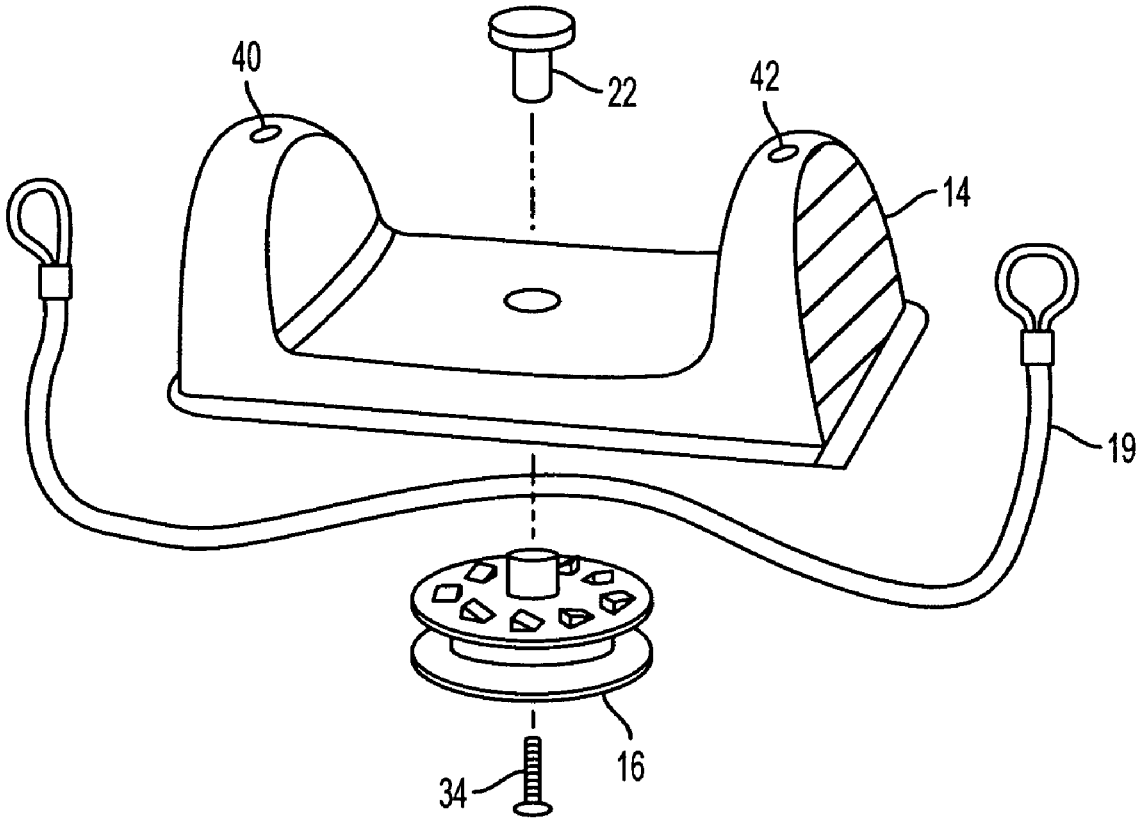
FIGS. 4A–C are exploded perspectives of different configurations of the swing seat.
Figure 4B:
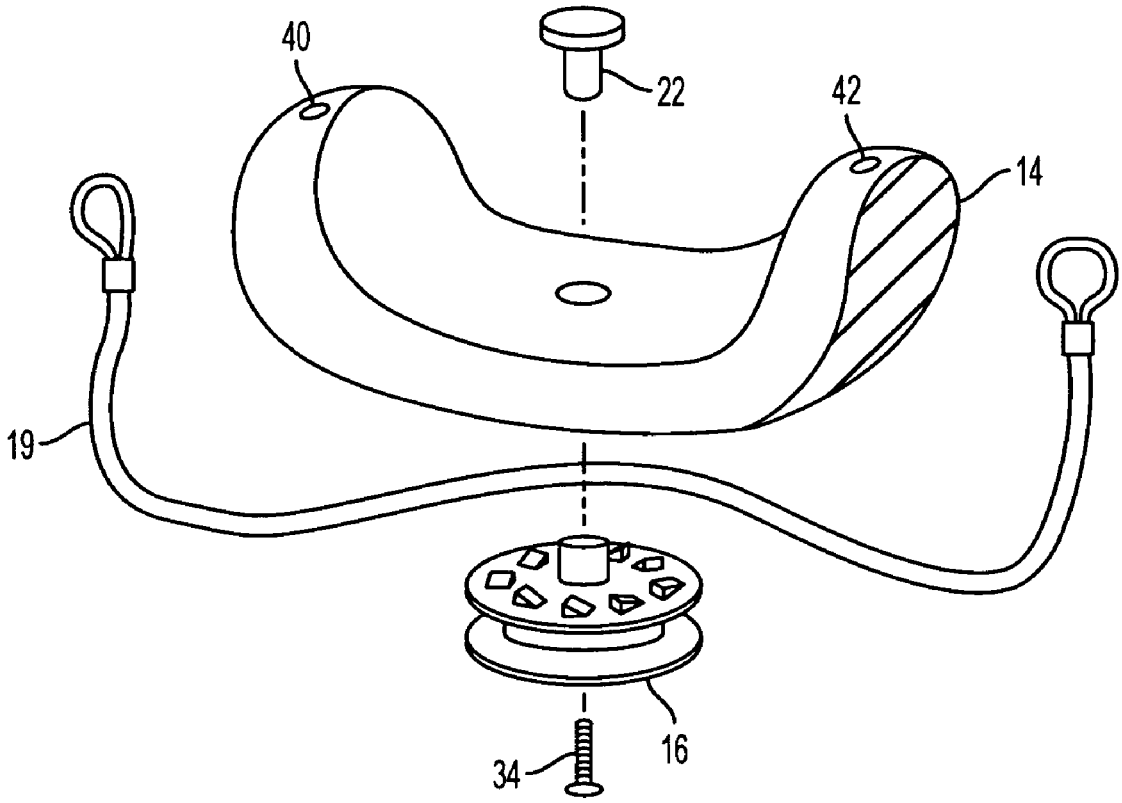
Figure 4C:
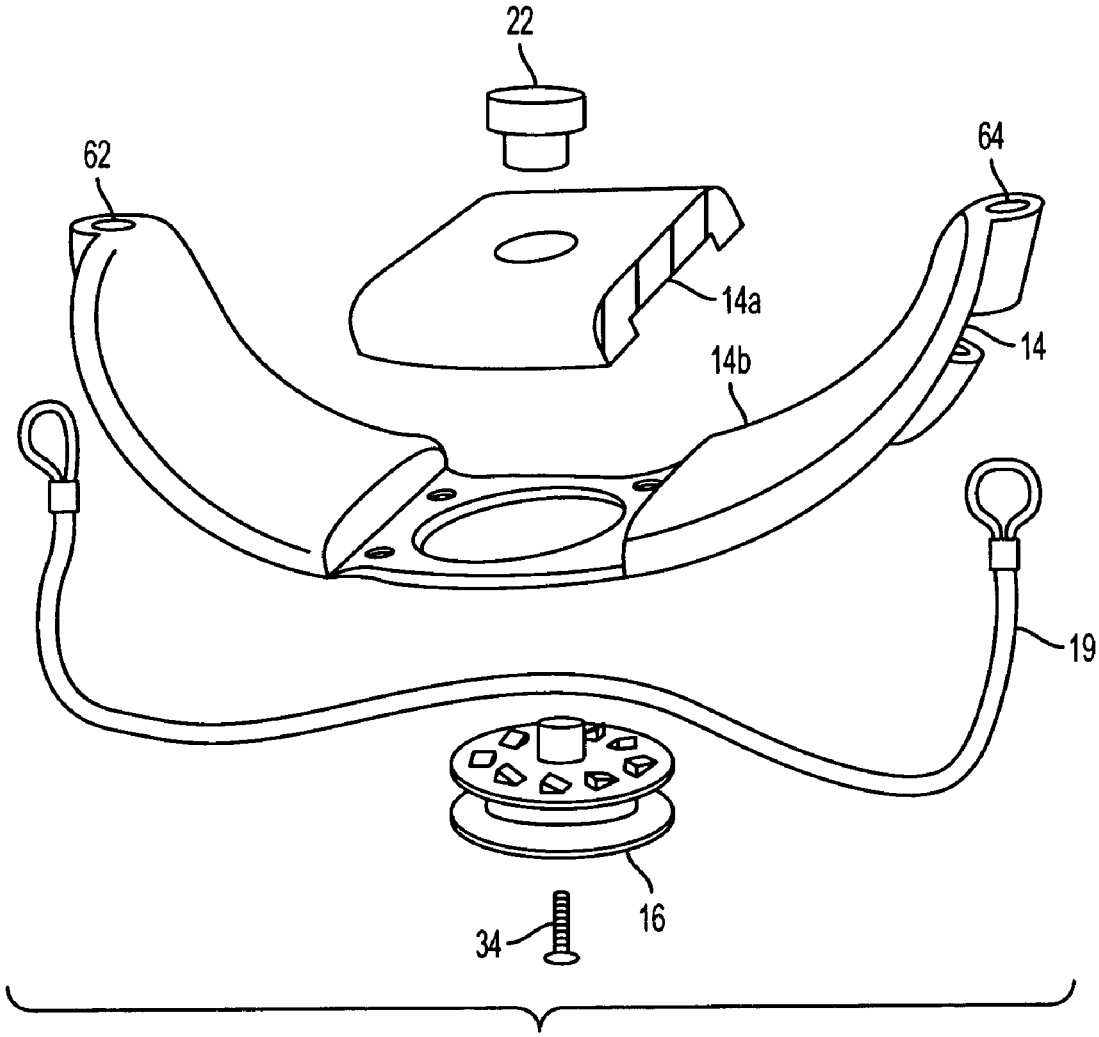

As illustrated in FIGS. 4A–C, the seat 12 and the seat shell 14 are not limited as to any particular configuration. As illustrated in FIGS. 4A and 4B, for example, the line 19 is positioned within the seat shell 14 and exits the seat shell 14 from an opening 40, 42. One alternative to this configuration, as illustrated in FIG. 4C, is to have the line 19 external to the seat shell 14 and guided along the sides of the seat shell by guides 62, 64. As illustrated in FIGS. 4A, 4B, the cross-sectional profile of the seat shell 14 is not limited to a particular configuration. As illustrated in FIG. 4C, the seat shell 14 is also not limited to single-piece construction. For example, the seat shell 14 can include a first shell 14*a* connected to a second shell 14*b*. Furthermore, the first shell 14*a* can be formed using a different material than the material used to form the second shell 14*b*. Also, the seat 12 and the seat shell 14 are not limited to particular materials. Illustrative examples of the materials from which the seat shell 14 can be formed include ABS (Acrylonitrile-Butadiene-Styrene), HDPE (High Density Polyethylene), and PVC (Polyvinyl Chloride).

The present concepts can be practiced by employing conventional materials, methodology and equipment. Accordingly, the details of such materials, equipment and methodology are not set forth herein in detail. In the previous descriptions, numerous specific details are set forth, such as specific materials, structures, processes, etc., in order to provide a thorough understanding. However, it should be recognized that the concepts outlined above can be practiced without resorting to the details specifically set forth. In other instances, well known structures have not been described in detail, in order not to unnecessarily obscure the present concept. It is to be understood that the present concepts are capable of application in various other combinations and environments and are capable of changes or modifications within the scope of the inventive concept as expressed herein.

What is claimed is:

1. A swing seat for attachment to at least one line of a swing, comprising:

a seat shell; and a reel rotatable in first and second rotational directions relative to the seat shell, wherein the reel is movable axially between first and second axial positions relative to the seat shell, the reel is configured to be attached to the at least one line, and in the first axial position, rotation in the first rotational direction of the reel relative to the seat shell is prevented.

2. The swing seat according to claim 1, wherein, when in the first axial position, the reel is rotatable relative to the seat shell only in the second rotational direction.

3. The swing seat according to claim 1, wherein, when in the second axial position, the reel is rotatable relative to the seat shell in the first and second rotational directions.

4. The swing seat according to claim 1, wherein, when in the first axial position, mechanical interference between the reel and seat shell prevents rotation in the first rotational direction.

5. The swing seat according to claim 4, wherein the reel and seat shell include complimentary ratchet elements, and when in the first axial position, the complimentary ratchet elements engage one another.

6. The swing seat according to claim 5, wherein, when the reel is in the second axial position, the complimentary ratchet elements disengage to allow rotation of the reel in the first rotational direction.

7. The swing seat according to claim 1, wherein rotation of the reel in the second rotational direction takes up the at least one line into the reel, and rotation of the reel in the first rotation direction releases the at least one line from the reel.

8. The swing seat according to claim 1, further comprising a release attached to the reel and movable relative to the seat shell.

9. The swing seat according to claim 8, wherein the release restricts movement of the reel to the first and second axial positions relative to the seat shell.

10. The swing seat according to claim 8, wherein axial movement of the reel relative to the seat shell in a first axial direction beyond the first axial position is prevented by engagement between the reel and the seat shell, and axial movement of the reel relative to the seat shell in a second axial direction beyond the second axial position is prevented by engagement between the release and the seat shell.

11. The swing seat according to claim 1, further comprising channels for guiding the at least one line from the reel and along the seat shell.

12. The swing seat according to claim 1, wherein the reel includes a divider.

13. The swing seat according to claim 1, wherein the reel is configured to be attached to two complimentary lines.

14. The swing seat according to claim 1, wherein the reel is configured to be attached to a common line extending from opposite sides of the reel.

15. The swing seat according to claim 1, further comprising includes a pawl, attached to one of the seat shell and the reel, and a plurality of teeth, attached to an other of the seat shell and the reel.

16. A swing seat for attachment to at least one line of a swing, comprising:

a seat shell; and a reel rotatable in first and second rotational directions relative to the seat shell, wherein the reel is configured for indexing between first and second positions relative to the seat shell and is configured to attach to the at least one line, and in the first position, rotation in the first rotational direction of the reel relative to the seat shell is prevented.

17. The swing seat according to claim 16, wherein, when in the second position, the reel is rotatable relative to the seat position in both the first and second rotational directions.

18. The swing seat according to claim 16, wherein, when the reel is in the first position, mechanical interference between the reel and the seat shell prevents rotation in the first rotational direction.

19. The swing seat according to claim 18, wherein the reel and seat shell include complimentary ratchet elements, and when the reel is in the first position, the complimentary ratchet elements engage one another.

20. The swing seat according to claim 19, wherein, when the reel is in the second position, the complimentary ratchet elements disengage to allow rotation of the reel in the first rotational direction.

* * * * *